US011355278B2

(12) United States Patent
Nogués Barrieras et al.

(10) Patent No.: US 11,355,278 B2
(45) Date of Patent: Jun. 7, 2022

(54) INSULATING TRANSFORMERS

(71) Applicant: Hitachi Energy Switzerland AG, Baden (CH)

(72) Inventors: Antonio Nogués Barrieras, Saragossa (ES); Carlos Roy Martín, Saragossa (ES); Lorena Cebrián Lles, Saragossa (ES); Rafael Murillo, Saragossa (ES); Luis Sánchez Lago, Vigo (ES); Rahul R. Shah, Vadodara (IN)

(73) Assignee: Hitachi Energy Switzerland AG, Baden (CH)

( * ) Notice: Subject to any disclaimer, the term of this patent is extended or adjusted under 35 U.S.C. 154(b) by 254 days.

(21) Appl. No.: 16/618,311

(22) PCT Filed: May 30, 2018

(86) PCT No.: PCT/EP2018/064197
§ 371 (c)(1),
(2) Date: Nov. 29, 2019

(87) PCT Pub. No.: WO2018/220018
PCT Pub. Date: Dec. 6, 2018

(65) Prior Publication Data

US 2020/0402708 A1 Dec. 24, 2020

(30) Foreign Application Priority Data

May 31, 2017 (EP) ..... 17382321

(51) Int. Cl.
*H01F 27/32* (2006.01)
*H01F 27/36* (2006.01)

(52) U.S. Cl.
CPC ..... *H01F 27/324* (2013.01); *H01F 27/327* (2013.01); *H01F 27/36* (2013.01); *H01F 2027/328* (2013.01)

(58) Field of Classification Search
CPC ..... H01F 27/324; H01F 27/327; H01F 27/36; H01F 2027/328; H01F 27/00–40
See application file for complete search history.

(56) References Cited

U.S. PATENT DOCUMENTS 2,442,274 A 5/1948 Mallett
3,551,863 A * 12/1970 Marton ..... H01F 27/085 336/58

(Continued)

FOREIGN PATENT DOCUMENTS

CH 229029 A 9/1943
DE 972108 C 5/1959

(Continued)

OTHER PUBLICATIONS

International Search Report and Written Opinion of the International Searching Authority. International Application No. PCT/EP2018/064197, issued by the European Patent Office, dated Sep. 24, 2018, 14 pages, Rijswijk, NL.

(Continued)

*Primary Examiner* — Tuyen T Nguyen
(74) *Attorney, Agent, or Firm* — Sage Patent Group

(57) ABSTRACT

Dry-type transformers with insulating modules are disclosed. Example insulating modules include dielectric screens and supporting blocks. The supporting blocks support the dielectric screens over windings of the transformer. The dielectric screens have first substantially even portions configured to adapt in spaces defined by corresponding cylindrical barriers arranged between first and second windings of the transformers and second substantially even portions, transversal to the first portions and to the first windings of the transformers and extending outwards from the first portions and beyond the supporting blocks. The dielectric screens partly extend around a winding.

16 Claims, 9 Drawing Sheets

(56) References Cited

U.S. PATENT DOCUMENTS

| | | | | |
|---|---|---|---|---|
| 4,126,843 | A | 11/1978 | Lampe | |
| 8,797,133 | B2 | 8/2014 | Murillo et al. | |
| 2013/0113579 | A1 | 5/2013 | Roy et al. | |
| 2017/0352473 | A1 * | 12/2017 | Wang | H01F 27/30 |

FOREIGN PATENT DOCUMENTS

| | | | | |
|---|---|---|---|---|
| DE | 1180054 | B | 10/1964 | |
| EP | 2439755 | A1 * | 4/2012 | H01F 27/324 |
| FR | 1160022 | A | 7/1958 | |
| GB | 1024624 | A | 3/1966 | |
| KR | 20010049163 | A | 6/2001 | |
| KR | 20130021420 | A | 3/2013 | |
| KR | 20130032875 | A | 4/2013 | |
| WO | 9834243 | A1 | 8/1998 | |

OTHER PUBLICATIONS

Korean Decision for Grant of Patent dated Apr. 1, 2022 for Korean Patent Application No. 10-2019-7036640, 3 pages (including English translation).

* cited by examiner

INSULATING TRANSFORMERS

FIELD

The present disclosure relates to transformers and more particularly to electrical insulation of transformers.

BACKGROUND

As is well known, a transformer converts electricity at one voltage level to electricity at another voltage level, either of higher or lower value. A transformer achieves this voltage conversion using a first coil and a second coil, each of which are wound around a ferromagnetic core and include a number of turns of an electrical conductor. The first coil is connected to a source of voltage and the second coil is connected to a load. The ratio of turns in the primary coil to the turns in the secondary coil ("turns ratio") is the same as the ratio of the voltage of the source to the voltage of the load.

Other types of transformers are also well known and are called multiwinding transformers. Such transformers use multiple windings connected in series or in parallel or independently depending on the desired functionality of the transformer.

To insulate two parts under voltage, e.g. a first coil and a second coil, insulating barriers are sometimes used. The insulating barriers are placed between the parts under voltage and are perpendicular to the electric field. Thus, the inclusion of the insulating barriers increases the electric field (and consequently the voltage) they can support. A given distance of air between the coils may withstand more voltage if the total space of air is split into smallest sections. This approach is applied in the insulation of dry-type transformers by including insulating barriers between the high-voltage (HV) and the low-voltage (LV) windings. The insulating barriers split the air gap between those windings.

Another example is when a solid insulating component is connecting or bridging two parts under voltage. It is common then to add insulating barriers or sheds to that component, perpendicular to the electric field, in order to improve its dielectric behavior. Such an example may be found in electrical insulators.

Yet another example is the use of block supports for the coils in dry-type transformers. The block supports separate the coils under voltage from the metallic structures, and can include such sheds.

For dry-type transformers above certain insulation levels (e.g. 12 kV), it is common to have one or more cylindrical barriers between HV and LV windings. It is also common to have one or more horizontal screens in the supporting blocks in order to increase the creepage distance. But even for relatively higher insulation levels (e.g. 72.5 kV) these barriers and screens do not form an integrated element.

For liquid-filled transformers above a certain insulation level it is common the use of horizontal screens (angle rings, collars) which are integrated with the HV-LV cylindrical barriers. FIG. 1 shows a liquid filled transformer 100 with HV winding 105, LV winding 110 and cylindrical barriers 115 in between. Angle rings 120 surround the cylindrical barriers while support blocks 125 separate and support the angle rings over the HV winding. Cellulose is used to manufacture angle rings or collars because it can be shaped as needed economically. However, it is not useful for dry-type transformers because it must be impregnated with liquid to work properly. Also it is not appropriate due to its poor mechanical endurance and low working temperature.

Other materials (e.g. Nomex™ or polyester) could be used in dry-type transformers but they are expensive and/or difficult to be shaped. Also mechanical and cooling issues add some restrictions on their use for dry-type transformers. In fact, for liquid-filled transformers, the angle rings or collars extend 360° in the tangential direction, covering the whole circumference of the winding. Furthermore, the supporting blocks are a potential weak point because they are bridging elements with the highest voltage differences (e.g. HV to LV and HV to core or clamp). Although enough clearance is kept in order to avoid problems in that zone, any improvement in the insulation involving the supporting blocks and avoiding the more complex and expensive solution of the collars or angle rings will lead to a more compact solution.

SUMMARY

To solve the above mentioned problems, insulating modules having supporting blocks with flexible L-shape screens are proposed. The proposed solution may be useful for transformers with two or more windings and cylindrical barriers in between and, preferably, for higher insulation levels, e.g. for 72.5 kV or 123 kV. The proposed solution is an arrangement that provides a practical insulating solution at a reduced cost.

In a first aspect, an insulating module for a transformer is disclosed. The insulating module may include a dielectric screen and a supporting block. The supporting block may support the dielectric screen over a first winding of the transformer. The dielectric screen may have a first substantially even portion configured to adapt in a space defined by a corresponding cylindrical barrier arranged between the first and a second winding of the transformer and a second substantially even portion, transversal to the first portion and to the first winding of the transformer and extending outwards from the first portion and beyond the supporting block.

The word "even" is used herein to mean smooth and without surface irregularities. In some examples the first and/or the second portion(s) may be flat and even whereas in other examples the first and/or the second portion(s) may be curved and even. The word "transversal" is used herein to mean that a plane of the second portion intersects the first portion at two or more lines. In a preferred embodiment the second portion may be perpendicular to the first portion.

By providing the dielectric screens between the supporting blocks and the cylindrical barriers, the direct discharge path along the surface of the supporting blocks is broken. The dielectric screens may be L-shaped and may be flexible to better adapt with the cylindrical barriers. Two different arrangements of the screens may be possible:

- If the supporting blocks are made of epoxy, then the screens may be inserted prior to casting. This allows for obtaining enough creepage distance.
- If the supporting blocks are assembled from different pieces, then the screens may be located between them. Two adjacent supporting blocks may be coupled using a connecting interface, e.g. a hole-pin interface, between them.

In some examples, the second portion may include an aperture to receive a connecting part of the supporting block. The supporting blocks may then be stacked one on top of the other, forming a supporting column, with the second portions interleaved between interlocked supporting blocks. As the aperture breaks the insulation, it may be selected or designed as small as possible, and be relatively centered with the cross-section of the supporting block in order to allow enough creepage distance.

In some examples, the transformer may include multiple cylindrical barriers. The insulating module may then include a plurality of dielectric screens. Each dielectric screen may be configured to be arranged with a different cylindrical barrier, respectively, of the transformer. As the height of the cylindrical barriers may increase in a direction from the outer winding to the inner winding, this may allow for better distribution of the L-shape screens along the supporting block column and for the progressive addition of insulating modules during assembly of the transformer. Thus an insulating module structure with various insulating modules may be implemented, which may be integrated with the transformer's cylinder barrier structure.

In some examples, the insulating module may include flexible dielectric screens, bent at a rim between the first portion and the second portion. This allows for easier insertion of the first portion of the insulating module between cylindrical barriers. It further allows for variable length between first and second portions; that is, dielectric screen may be bent along a line according to the distance between the respective supporting block and the cylindrical barrier. This allows for the same type of dielectric screen to be used for different distances of cylindrical barriers.

In some examples, the first portion may have a curvature to match a curvature of the corresponding cylindrical barrier. The curvature may be pre-established or it may be formed during installation, assuming the dielectric screen to be flexible.

In some examples the insulating module may include a single piece of dielectric material. The single piece may include the dielectric screens and the supporting blocks.

In some examples the dielectric screens and/or the supporting blocks may be made of resin. The use of resin may provide insulating properties to the insulation module.

In some examples, the dielectric screens may include one or more insulation layers. The amount of insulation layers may be associated with higher insulation properties (more layers may provide higher insulation) and/or higher flexibility (less layers may result in higher flexibility). The layers may also be partial, i.e. the first portion may include different amount of layers than the second portion.

In some examples, the insulating module may further include horizontal sheds extending radially outwards from the supporting blocks. This allows for improved insulation between the HV winding and the yoke and clamps because the sheds increase the creepage distance along the supporting block surface.

In some examples, at least the first or the second part of the dielectric screen may partly extend around the second winding along the corresponding cylindrical barrier. In some implementations more than one insulating module may be distributed around the cylinder. For example, four insulating modules may be arranged around the cylinder barriers each covering a quarter of the cylinder barrier circumference.

In some examples, at least one block extends above the cylindrical barriers and has a portion resting on the second winding of the transformer. This allows for better structural integrity of the overall transformer construction, In another aspect, a transformer is disclosed. The transformer may include at least a first winding, at least a second winding, cylindrical barriers between the at least first and second windings, and insulating modules according to examples disclosed herein.

In some examples, the transformer may be a dry-type transformer, the first winding may be a LV winding and the second winding may be a HV winding.

In some examples, the transformer may have multiple windings. Sets of insulating modules may then be arranged between consecutive windings.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
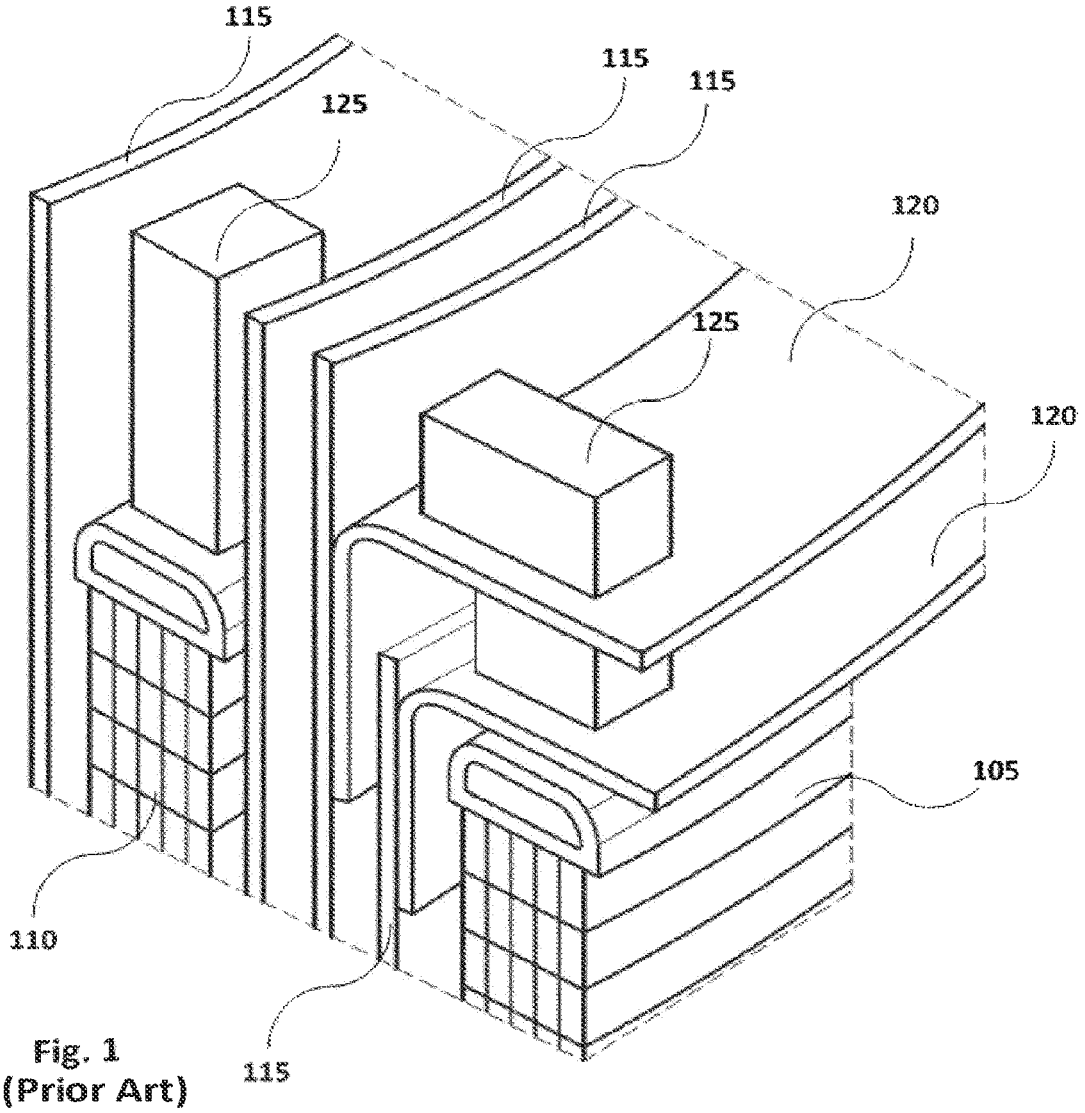
Fig. 1 (Prior Art)
FIG. 1 is a schematic partial view of a prior transformer having angle rings.

FIG. 2 is a schematic view of an insulating module according to an example. Insulating module 200 may include a screen 205 and a supporting block 210. The screen may include a first portion 215 and a second portion 220. The second portion 220 may extend from a rim of the first portion 215 and may be substantially flat and perpendicular to the first portion 215. The first portion 215 may include one or more layers of dielectric material and may have a size (thickness) configured to fit in a space defined by one or more cylindrical barriers of a transformer. Such space may be the space between a winding and a cylindrical barrier or the space between two consecutive cylindrical barriers.

Figure 2A:
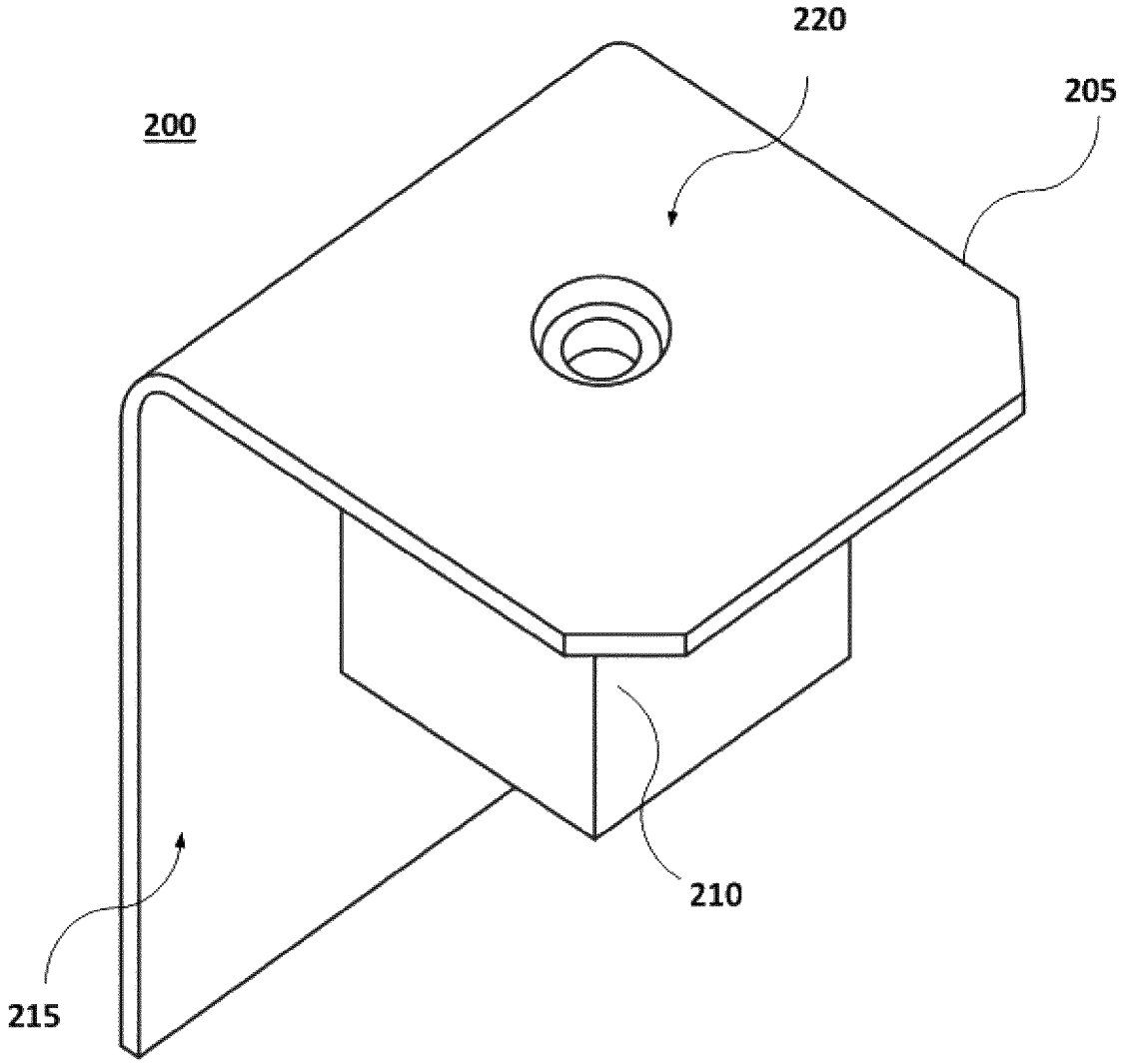
FIG. 2A is a perspective view of an insulating module according to an example.
Figure 2B:
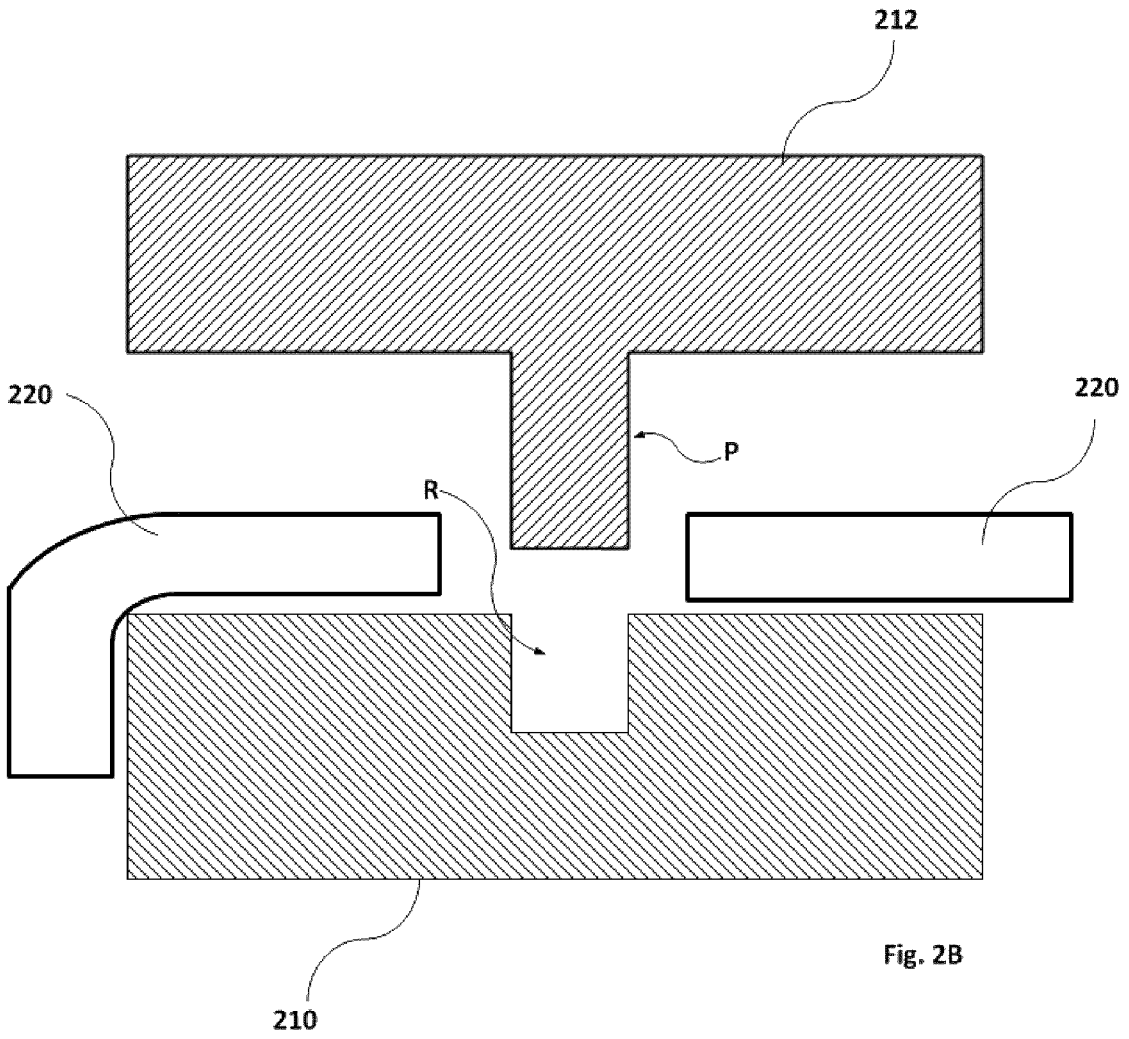
FIG. 2B is a sectional view of an insulating module according to an example.

The second portion 220 may include an aperture. The aperture may be designed to host at least part of the supporting block 210. In the example of FIGS. 2A and 2B, the aperture may be circular and the supporting block 210 may have a top portion with an aperture or recession R substantially corresponding to the aperture of the second portion 220 of the screen. As shown in FIG. 2B the recession R may be sized to match a corresponding protrusion P of another supporting block 212.

The example of FIG. 2A and FIG. 2B is merely one example of how the second portion and the supporting block may interconnect. In other examples, the top portion of the supporting block may include the protrusion and another supporting block may include a recession at a bottom part to receive the protrusion. In yet other examples, the second portion and the supporting block may be cast in one piece. In yet other examples, more than one screen and more than one supporting block may be cast in one piece. Thus, there may be no need for apertures and/or interlocking pieces. One skilled in this field may appreciate that other configurations may also be possible.

Figure 2C:
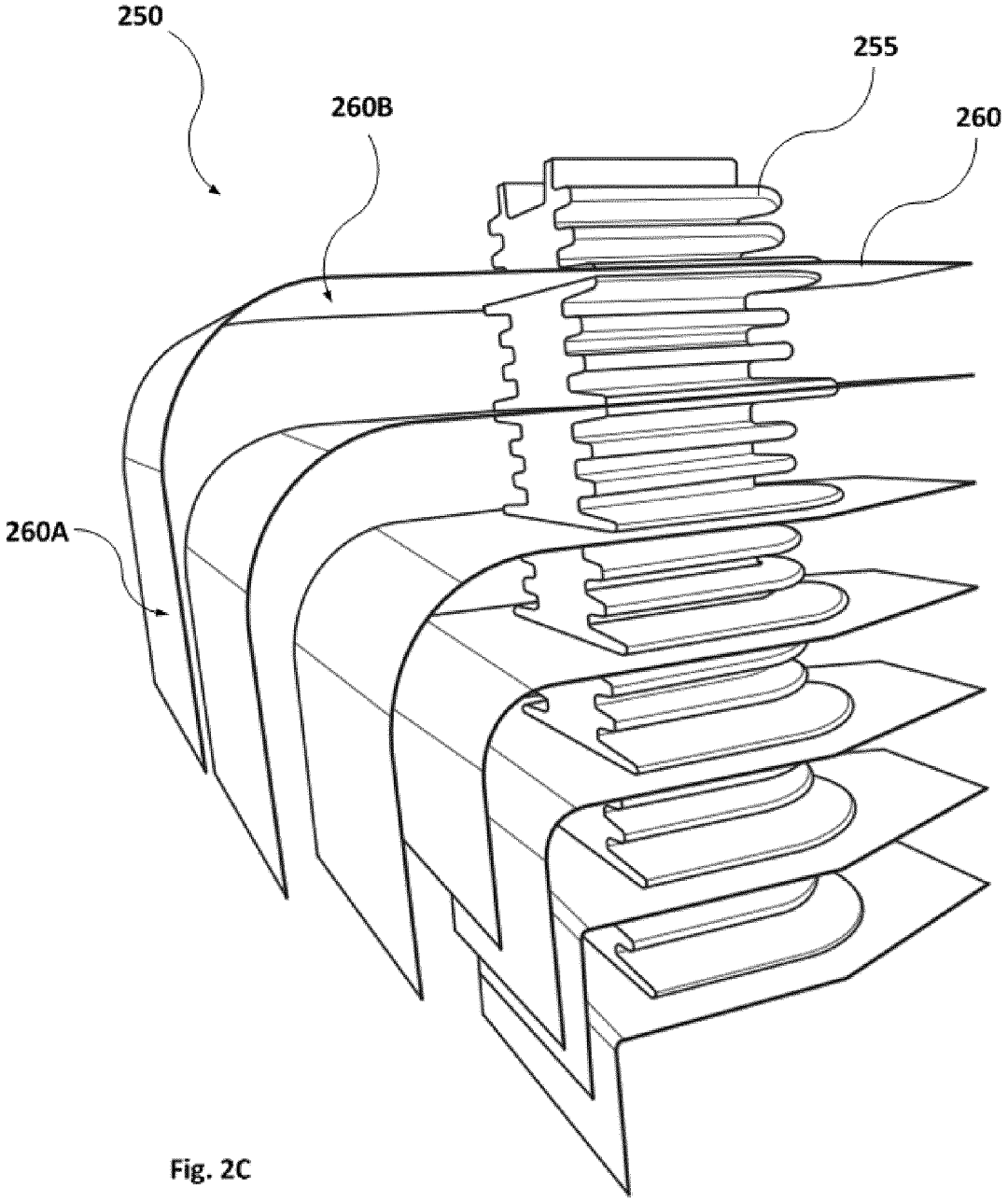
FIG. 2C is a perspective view of a multi-screen insulating module according to an example.

FIG. 2C is a perspective view of a multi-screen insulating module according to an example. The insulating module 250 may include a supporting block column 255 in the form of a single piece of dielectric material (e.g. epoxy resin) with dielectric screens 260. The lower part of the supporting block column 255 may be configured to be resting on a winding, e.g. HV winding, of a transformer. Each screen may have one or more holes to allow the epoxy to flow during the casting of the supporting block column 255, so all elements form a single piece. Each screen may have a first portion 260A substantially parallel to the supporting block column 255 and a second portion 260B traversing the supporting block column 255. Said traversing may be perpendicular to the axis of the supporting block column. The first portions may be configured or shaped, e.g. the may be curved, to adapt to a space between cylindrical barriers of the transformer. Starting from the lower dielectric screen and moving upwards, the second portions 260B may progressively get longer as the respective dielectric screens may correspond to cylindrical barriers that are further away from the supporting block column 255. The second portions may also include a central hole to allow for the hole-pin interface of the supporting blocks to engage as shown in FIGS. 2A and 2B.

Figure 3:
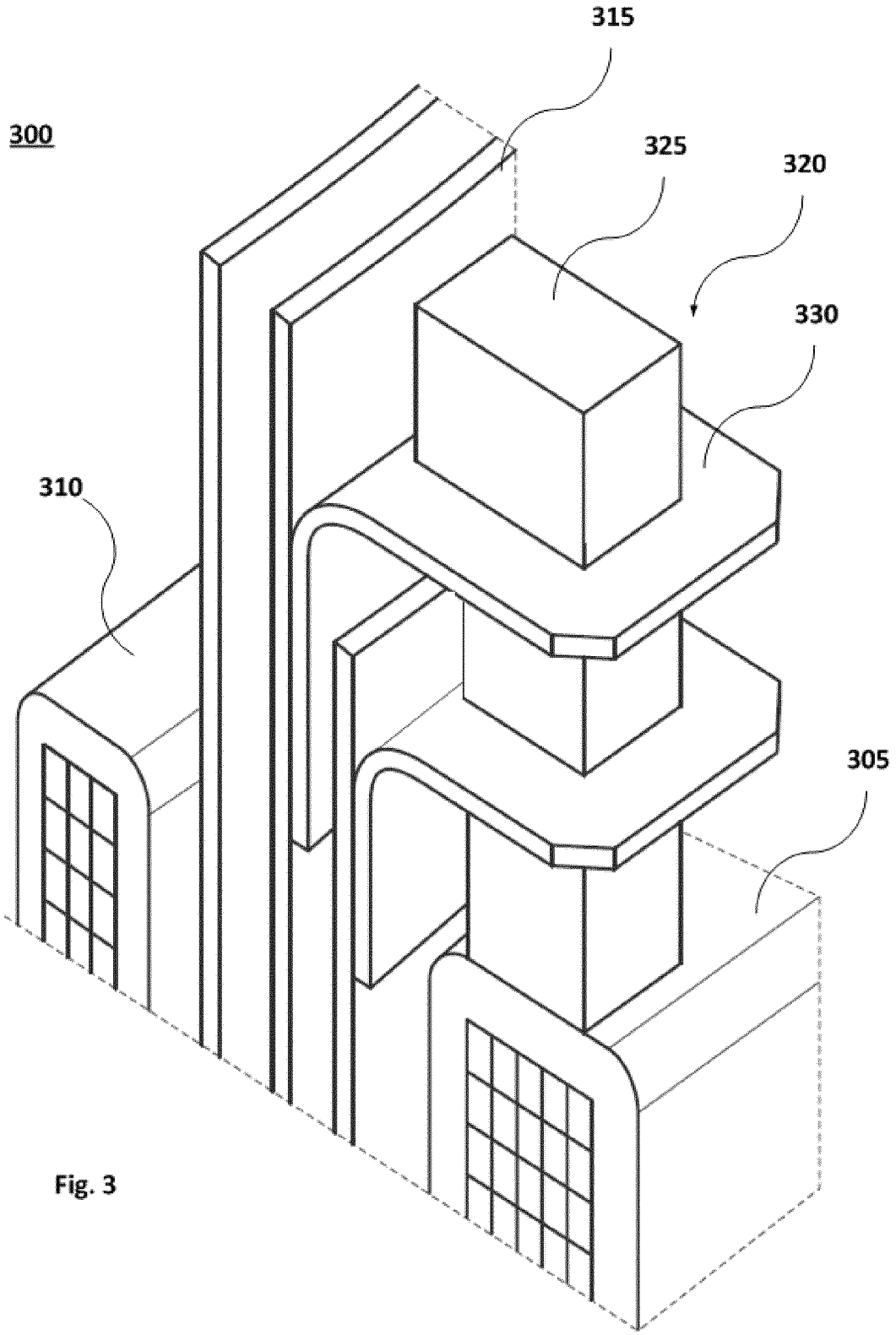
FIG. 3 is a schematic partial view of a transformer including insulating modules according to an example.

FIG. 3 is a schematic partial view of a transformer having insulating modules according to an example. Transformer 300 may be a dry-type transformer. The transformer 300 may include an HV winding 305 and an LV winding 310. A series of cylindrical barriers 315 may be interposed between the HV winding 305 and the LV winding 310. On top of the HV winding an insulation module 320 may be placed. The insulation module 320 may include supporting blocks 325 and flexible L-shape screens 330 stacked one on top of the other. Each supporting block 325 may support a screen 330. Each screen 330 may be arranged with a cylindrical barrier. Starting from the bottom and going upwards, the first screen 330 may be arranged with the first cylindrical barrier between the HV winding and the LV winding. The first (bottom) supporting block 325 may thus support the first (lowermost) screen 330. Accordingly, the second supporting block 325 may support the second screen and so on. The second portion of the second screen may partially extend over the first cylindrical barrier so that the first portion of the screen may be arranged with the second cylindrical barrier. Accordingly, the second portion of the third screen may partially extend over the first and the second cylindrical barrier so that the first portion of the third screen may be arranged with the third cylindrical barrier. As the distance between the HV winding and the barriers increases when arranging screens with cylindrical barriers in a direction approaching the LV winding 310, the second portion may be longer in the radial direction of the transformer. To maximize structural support, supporting blocks may be placed on top of the uppermost screen and may extend beyond the innermost cylindrical barrier and include a second pillar that may be supported on the LV winding. The L-shape screens may be placed almost parallel to the equipotential lines to maximize insulation properties. To accomplish this, the bending radius at the rim between the first portion and the second portion may increase as the distance from the HV winding increases.

Figure 4:
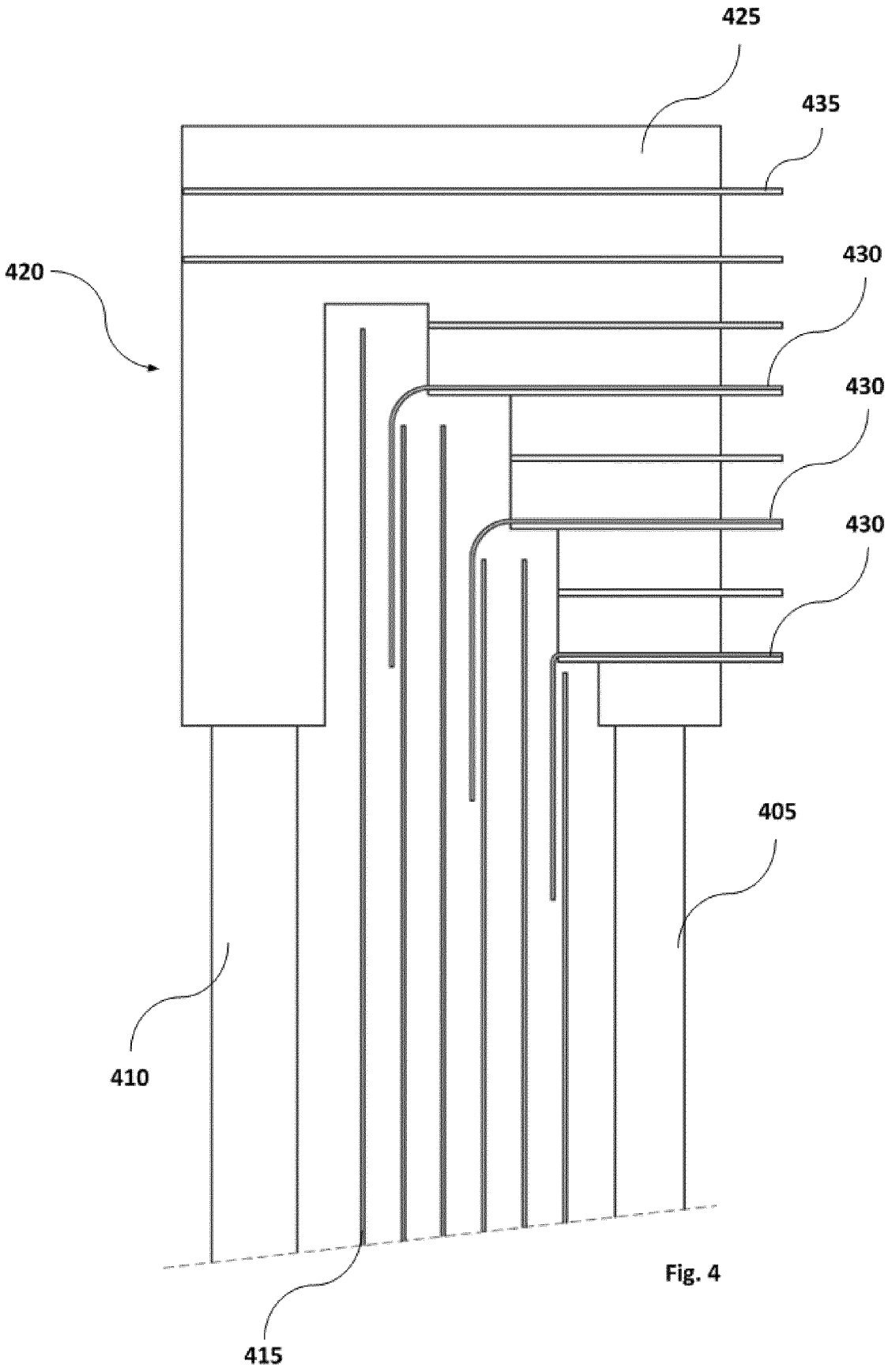
FIG. 4 is a schematic sectional view of a transformer including insulating modules according to an example.

FIG. 4 is a schematic sectional view of a transformer having insulating modules according to an example. In the example of FIG. 4, six cylindrical barriers are arranged between HV winding 405 and LV winding 410. An insulating module 420 may be arranged between the HV winding 405 and the LV winding 410. The insulating module 420 may include a set of supporting blocks 425 interrupted by inverse L-shape screens 430. In the example of FIG. 4, three screens 430 are arranged with the three cylindrical barriers, respectively. Each screen 430 is supported by a respective supporting block 425. On top of the uppermost screen 430, a supporting block may be placed extending above and beyond the innermost cylindrical barrier and extending vertically to be supported on the LV winding, thus the insulating module 420 may be π (pi) shaped having a leg in the form of an inverse pyramid.

Each supporting block may include a single element, as is shown in FIG. 4, or may include one element for the LV winding and another for the HV winding without any mechanical connection between them. The latter is preferable to supporting blocks made of epoxy because their casting is then simpler. Furthermore, some supporting blocks may include horizontal sheds extending outwards from the main supporting block structure. It is also possible to incorporate the insulating modules with angular rings or collars. In FIG. 4, sheds 435 are interposed between supporting blocks thus maximizing the insulation properties of the transformer.

Figure 5A:
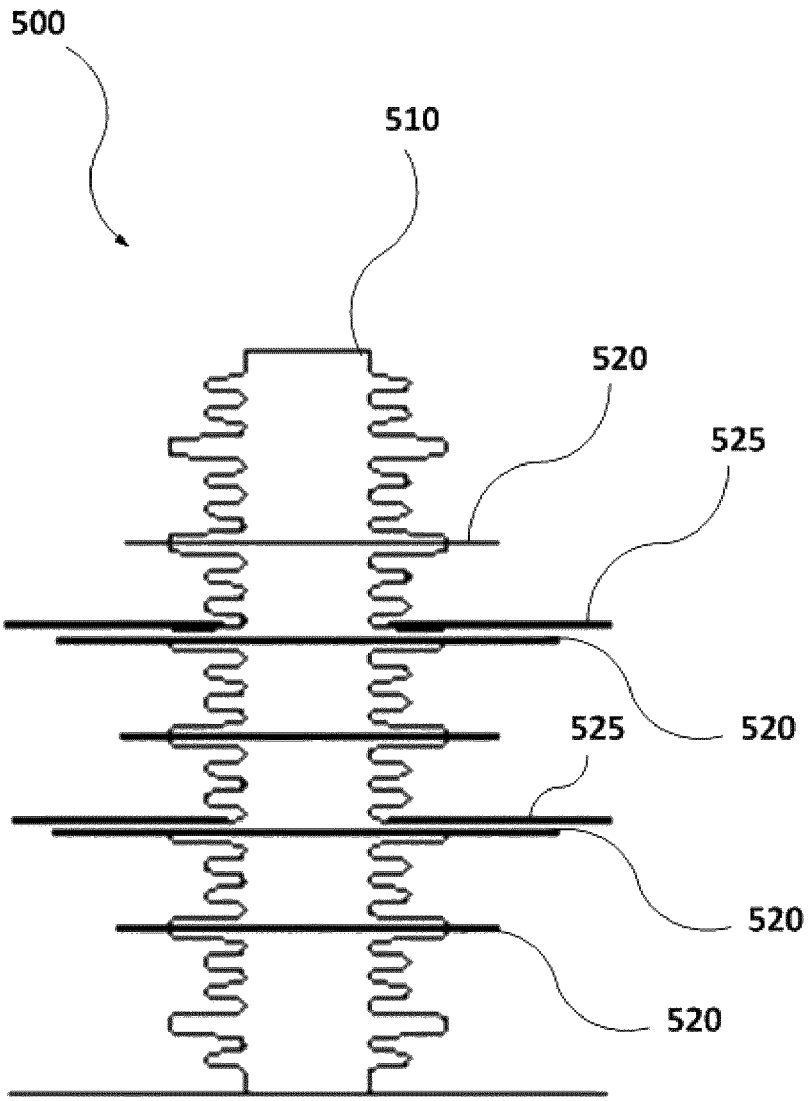
FIG. 5A is a section view of an insulating module cast in one piece, according to an example.

FIG. 5A is a section view of an insulating module cast in one piece, according to an example. The insulating module 500 may include a supporting block column 510, integrated dielectric screens 520 and collars 525. The supporting block column and dielectric screens may be cast in one piece and may be made, for example, by epoxy resin. Thus various protrusions may extend outwards from the supporting blocks to increase creepage. Collars 525 may be resting on top of the screens 520. In other examples the dielectric screens may also be cast using the same mold and also be made of resin.

Figure 5B:
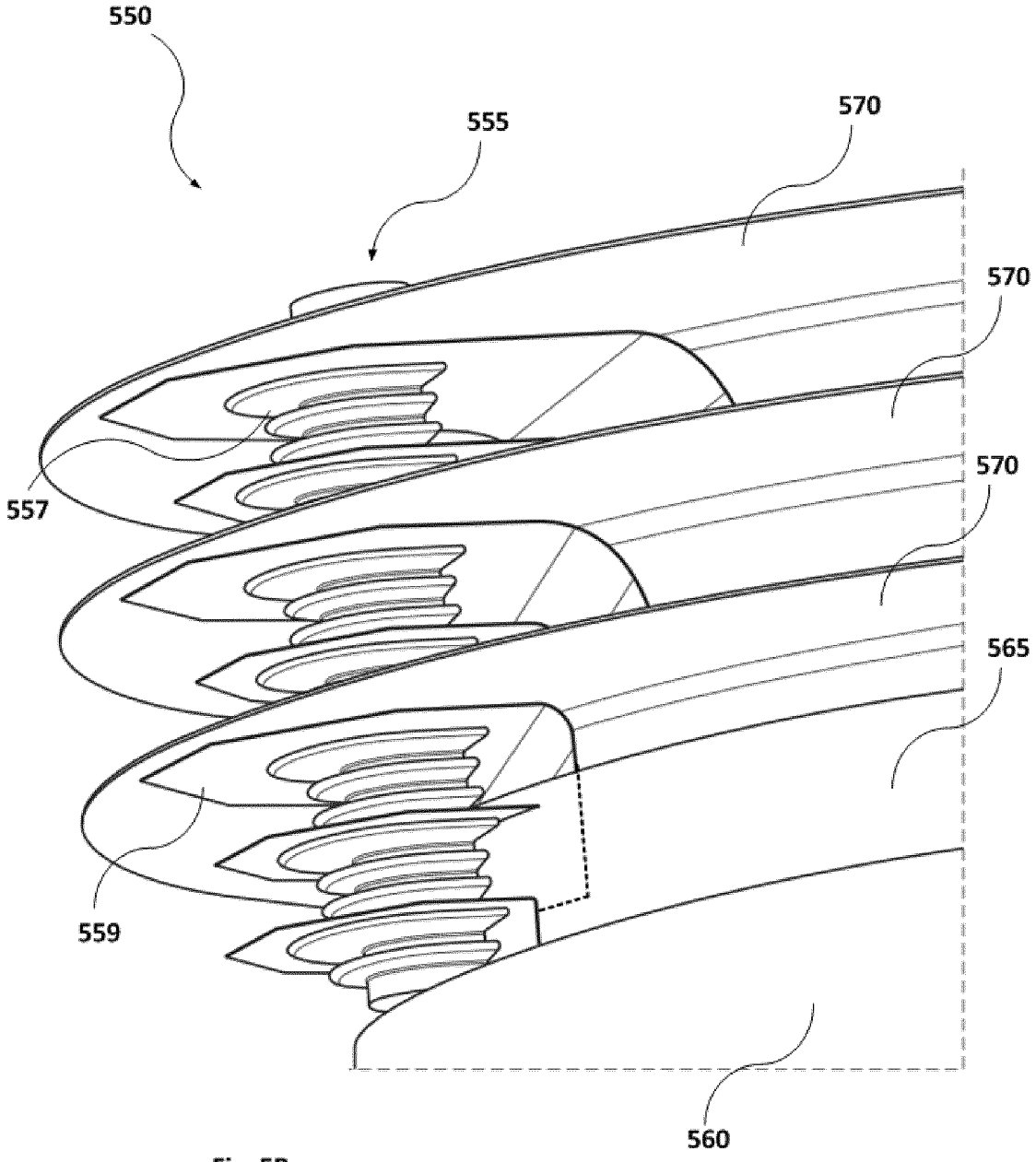
FIG. 5B is a perspective view of a transformer portion with an insulating module, according to an example.

FIG. 5B is a perspective view of a transformer portion with an insulating module, according to an example. Transformer 550 may include insulating module 555, winding 560, cylindrical barriers 565 and collars 570. Insulating module 555 may include supporting blocks 557 and dielectric screens 559. The dielectric screens 559 may have a first portion parallel to the supporting block column and may be arranged to fit in a space between the cylindrical barriers 565. A second portion may be transversal, preferably perpendicular, to the first portion and may traverse the supporting block column. The collars 570 may rest on top of the second portion of dielectric screens 559.

Figure 6:
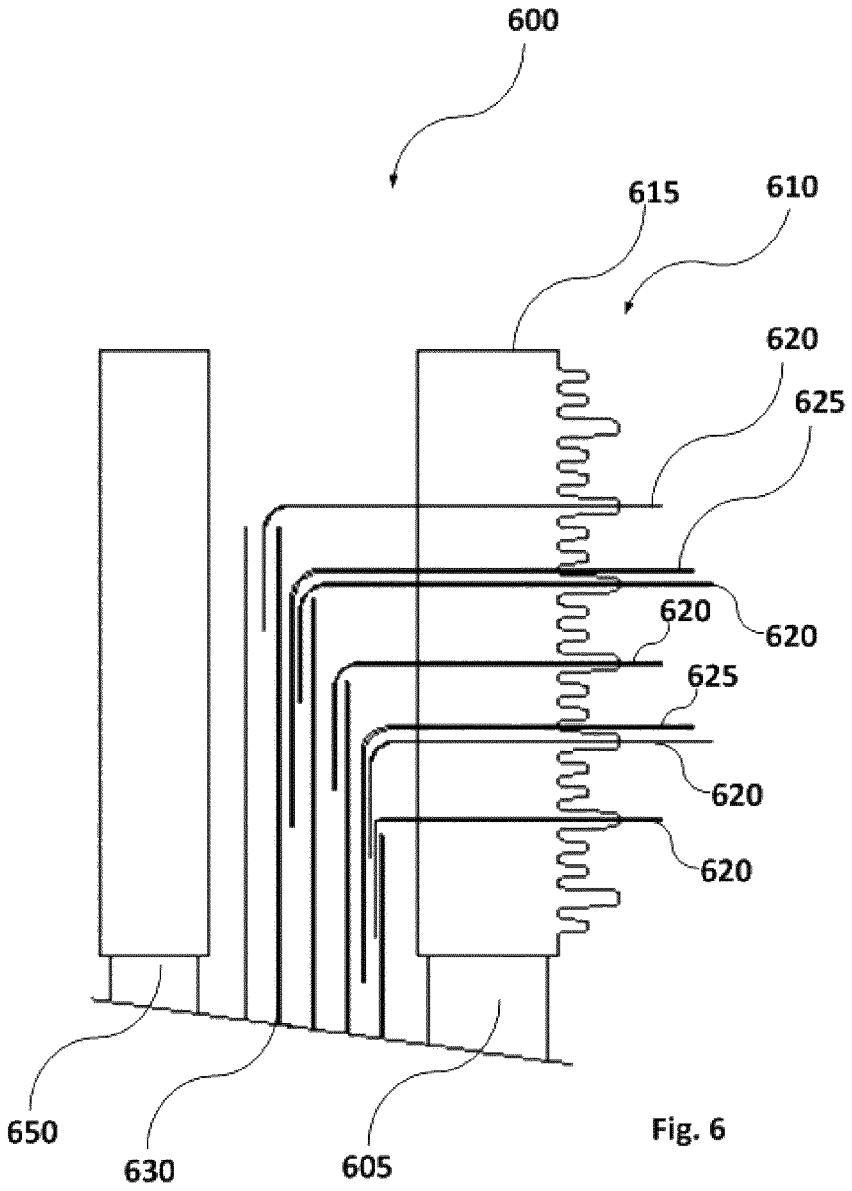
FIG. 6 is a section view of a transformer with an insulating module cast in one piece, according to an example.

FIG. 6 is a section view of a transformer with an insulating module cast in one piece, according to an example. Transformer 600 may include a first winding 605 and a second winding 650. On top of the first winding 605 an insulating module 610 may rest. More specifically, the insulating module 610 may include a supporting block column 615 and dielectric screens 620. Cylindrical barriers may be arranged between the first winding 605 and the second barrier 650. First portions of the dielectric screens may be arranged in spaces between the cylindrical barriers, extend beyond the cylindrical barriers and be connected at a rim with second portions, transversal, preferably perpendicular, to the first portions. The second portions may traverse the supporting block column and extend beyond the supporting block column. Collars 625 may be resting on top of second portions of dielectric screens 620.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow. If reference signs related to drawings are placed in parentheses in a claim, they are solely for attempting to increase the intelligibility of the claim, and shall not be construed as limiting the scope of the claim.

The invention claimed is:

1. A dry-type transformer, comprising:

at least a first winding;

at least a second winding;

one or more cylindrical barriers between the at least first and second windings;

one or more insulating modules, each insulating module comprising:

a dielectric screen and a supporting block, the supporting block to support the dielectric screen over the first winding of the transformer, the dielectric screen partly extending around the second winding and having a first substantially even portion configured to adapt to a space defined by a corresponding one of the one or more cylindrical barriers arranged between the first and a second windings of the transformer and a second substantially even portion, transversal to the first portion and to the first winding of the transformer and extending outwards from the first portion and beyond the supporting block.

2. The dry-type transformer, according to claim 1, the second portion comprising an aperture to receive a connecting part of the supporting block.

3. The dry-type transformer according to claim 1, the one or more cylindrical barriers comprising multiple cylindrical barriers, each insulating module comprising:

a plurality of dielectric screens, each dielectric screen configured to be arranged with a different cylindrical barrier, respectively, of the transformer.

4. The dry-type transformer according to claim 1, comprising one or more flexible dielectric screens, bent at a rim between the first portion and the second portion.

5. The dry-type transformer according to claim 1, the first portion having a curvature to match a curvature of the corresponding cylindrical barrier.

6. The dry-type transformer according to claim 1, comprising a single piece, the dielectric screen being made of a first dielectric material and the supporting block being made of a second dielectric material.

7. The dry-type transformer according to claim 1, the dielectric screen or the supporting block or both being made of resin.

8. The dry-type transformer according to claim 1, each dielectric screen comprising one or more insulation layers.

9. The dry-type transformer according to claim 1, further comprising one or more horizontal sheds extending radially outwards from the supporting block.

10. The dry-type transformer according to claim 1, at least the first or the second part of the dielectric screen partly extending around the second winding along the corresponding cylindrical barrier.

11. The dry-type transformer according to claim 1, the supporting block being stacked one on top of another supporting block with the second portions interleaved between interlocked supporting blocks.

12. The dry-type transformer according to claim 1, the first winding being an LV winding and the second winding being an HV winding.

13. The dry-type transformer according to claim 12, at least one block extending above the one or more cylindrical barriers and comprising a portion resting on one or more LV windings of the transformer.

14. The dry-type transformer according to claim 1, the one or more insulating modules further comprising one or more respective collars.

15. The dry-type transformer according to claim 14, the one or more respective collars resting on top of a dielectric screen or screens.

16. A dry-type transformer according to claim 1, comprising multiple windings, sets of insulating modules being arranged between consecutive windings.

* * * * *